US012066021B2

(12) United States Patent
Poehls et al.

(10) Patent No.: US 12,066,021 B2
(45) Date of Patent: Aug. 20, 2024

(54) MODULAR SUCTION GLAND ASSEMBLY

(71) Applicant: SPM Oil & Gas Inc., Fort Worth, TX (US)

(72) Inventors: Justin Lane Poehls, Glen Rose, TX (US); Connor Robert Landrum, Burleson, TX (US); David Theodore Figgs, Fort Worth, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 64 days.

(21) Appl. No.: 17/995,187

(22) PCT Filed: Apr. 14, 2021

(86) PCT No.: PCT/US2021/027364

§ 371 (c)(1),
(2) Date: Sep. 30, 2022

(87) PCT Pub. No.: WO2021/211767

PCT Pub. Date: Oct. 21, 2021

(65) Prior Publication Data

US 2023/0141878 A1 May 11, 2023

Related U.S. Application Data

(60) Provisional application No. 63/010,032, filed on Apr. 14, 2020.

(51) Int. Cl.

| | |
|---|---|
| ***F04B 53/16*** | (2006.01) |
| ***F04B 23/06*** | (2006.01) |
| ***F04B 53/22*** | (2006.01) |

(52) U.S. Cl.
CPC ..... *F04B 53/22* (2013.01); *F04B 23/06* (2013.01); *F04B 53/16* (2013.01)

(58) Field of Classification Search
CPC ..... F04B 53/22; F04B 53/16; F04B 39/14; F16J 13/00–02; E21B 43/00; E21B 43/12; E21B 43/126
See application file for complete search history.

(56) References Cited

U.S. PATENT DOCUMENTS 2,981,575 A * 4/1961 Leman ..... F16J 13/02 220/304
5,253,987 A 10/1993 Harrison
(Continued)

OTHER PUBLICATIONS

International Search Report and Written Opinion issued in Application No. PCT/US2021/027364; Dated Jul. 19, 2021, 8 Pages.

*Primary Examiner* — Thomas Fink

(57) ABSTRACT

A positive displacement pump includes a suction cover disposed in a suction access bore defined in the fluid end and housing, where the suction cover is configured to cover the suction access bore. A retainer nut is configured for abutting against the suction cover and retaining the suction cover within the suction access bore. A suction gland has an inner circumferential threaded interface configured to engage an external circumferential threaded interface defined on the retainer nut, and the suction gland has a plurality of threaded openings configured to receive a plurality of threaded fasteners that can be used for securely fastening the suction gland to the fluid end housing.

21 Claims, 6 Drawing Sheets

(56) References Cited

U.S. PATENT DOCUMENTS

| | | | | |
|---|---|---|---|---|
| 5,362,215 | A * | 11/1994 | King | F04B 49/10 137/542 |
| 2007/0295411 | A1 | 12/2007 | Schwegman | |
| 2012/0141308 | A1 | 6/2012 | Saini et al. | |
| 2016/0169385 | A1* | 6/2016 | Patterson | F04B 53/16 92/169.1 |
| 2016/0369909 | A1* | 12/2016 | Deel | F04B 39/14 |
| 2019/0072088 | A1 | 3/2019 | DeLeon, II et al. | |
| 2019/0376508 | A1 | 12/2019 | Wagner et al. | |
| 2022/0412346 | A1* | 12/2022 | Nowell | E21B 43/2607 |

* cited by examiner

MODULAR SUCTION GLAND ASSEMBLY

CROSS-REFERENCE TO RELATED APPLICATIONS

This Patent Application is a 371 national stage of PCT Application No. PCT/US2021/027364, filed on Apr. 14, 2021, entitled "MODULAR SUCTION GLAND ASSEMBLY," which claims priority to U.S. Provisional Application No. 63/010,032, filed on Apr. 14, 2020, entitled "MODULAR SUCTION GLAND ASSEMBLY," and assigned to the assignee hereof. The disclosures of the prior Applications are considered part of and are incorporated by reference into this Patent Application.

FIELD

The present disclosure relates to hydraulic fracturing pumps, and in particular, to a modular suction gland assembly for a hydraulic fracturing pump.

BACKGROUND

Hydraulic fracturing (a.k.a. fracking) is a process to obtain hydrocarbons such as natural gas and petroleum by injecting a fracking fluid or slurry at high pressure into a wellbore to create cracks in deep rock formations. The hydraulic fracturing process employs a variety of different types of equipment at the site of the well, including one or more positive displacement pumps, slurry blender, fracturing fluid tanks, high-pressure flow iron (pipe or conduit), wellhead, valves, charge pumps, and trailers upon which some equipment are carried.

Positive displacement pumps are commonly used in oil fields for high pressure hydrocarbon recovery applications, such as injecting the fracking fluid down the wellbore. A positive displacement pump typically has two sections, a power end and a fluid end. The power end includes a crankshaft powered by an engine that drives the plungers. The fluid end of the pump includes cylinders into which the plungers operate to draw fluid from a suction manifold into the fluid chamber and then forcibly push out at a high pressure to a discharge manifold, which is in fluid communication with a well head.

DETAILED DESCRIPTION

The primary purpose of the suction access bore in a positive displacement pump is to provide service access to consumable components within the fluid cylinder of the pump. Conventional suction cover configurations in a positive displacement pump consists of a retainer nut that directly engages the fluid end block via a threaded connection. The retainer nut is the device that holds the suction cover in place over the suction bore access opening in the fluid end block. The suction covers are typically sealed with pressure energized seals, such as O-rings or D-ring seals. The seals prevent pressure leaks from the fluctuating pressure in the cross bores in the fluid cylinder of the pump. One of the most common reasons for failure and pressure loss is due to cyclic loading or wash rings around the sealing surfaces of the suction cover seal. In conventional pumps, such a thread failure associated with the retainer nut would mean scrapping the entire fluid end block.

Figure 1:
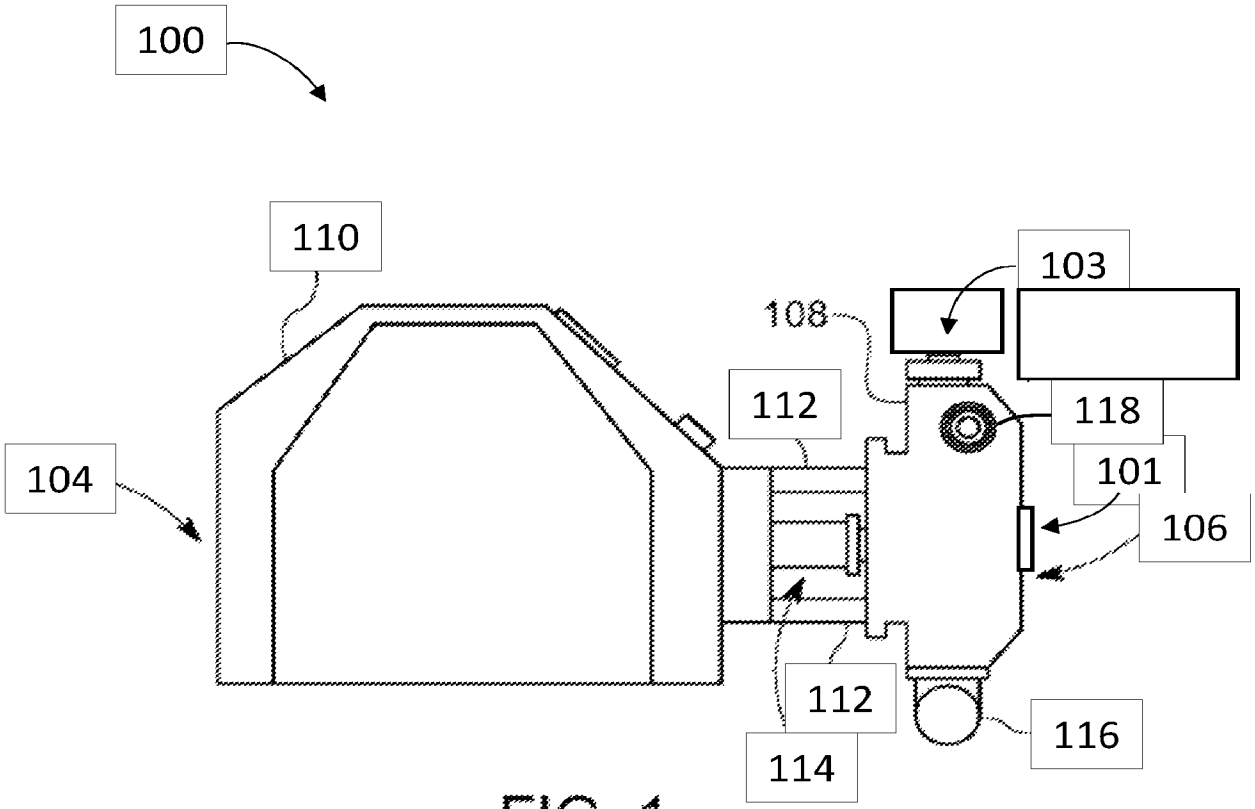
FIG. 1 is an elevational view of an example of a positive displacement pump that may employ modular suction gland assemblies according to the teachings of the present disclosure.

FIG. 1 is an elevational view of a reciprocating positive displacement pump 100 that incorporates a suction cover assembly 101 described herein. The reciprocating pump 100 has two sections, a power end 104 and a fluid end 106. The fluid end 106 of the pump 100 includes a fluid end housing 108, which is connected to the power end housing 110 via a plurality of stay rods 112. In operation, crankshafts (not explicitly shown) reciprocate plunger rod assemblies between the power end 104 and the fluid end 106. The crankshafts are powered by an engine or motor (not explicitly shown) that drives plunger rod assemblies 114 to create alternating high and low pressures inside each respective pressure chamber. The cylinders operate to draw fluids from a suction manifold 116 into the pressure chambers and then discharge the fluid at a high pressure to a discharge manifold 118. The discharged fluid is then injected at high pressure into an encased wellbore in a fracking operation. The injected fracturing fluid is also commonly called a slurry, which is a mixture of water, proppants (silica sand or ceramic), and chemical additives. The pump 100 can also be used to inject a cement mixture down the wellbore for cementing operations. The pump 100 may be freestanding on the ground, mounted to a skid, or mounted to a trailer. The suction cover assemblies 101 are used to seal off access ports to the pressure chambers within the fluid cylinders to enable access to service the inlet valve assemblies and the plunger rod assemblies 114. Discharge cover assemblies 103 are used to seal off discharge access ports to enable access to service the outlet valve assemblies.

Figure 2:
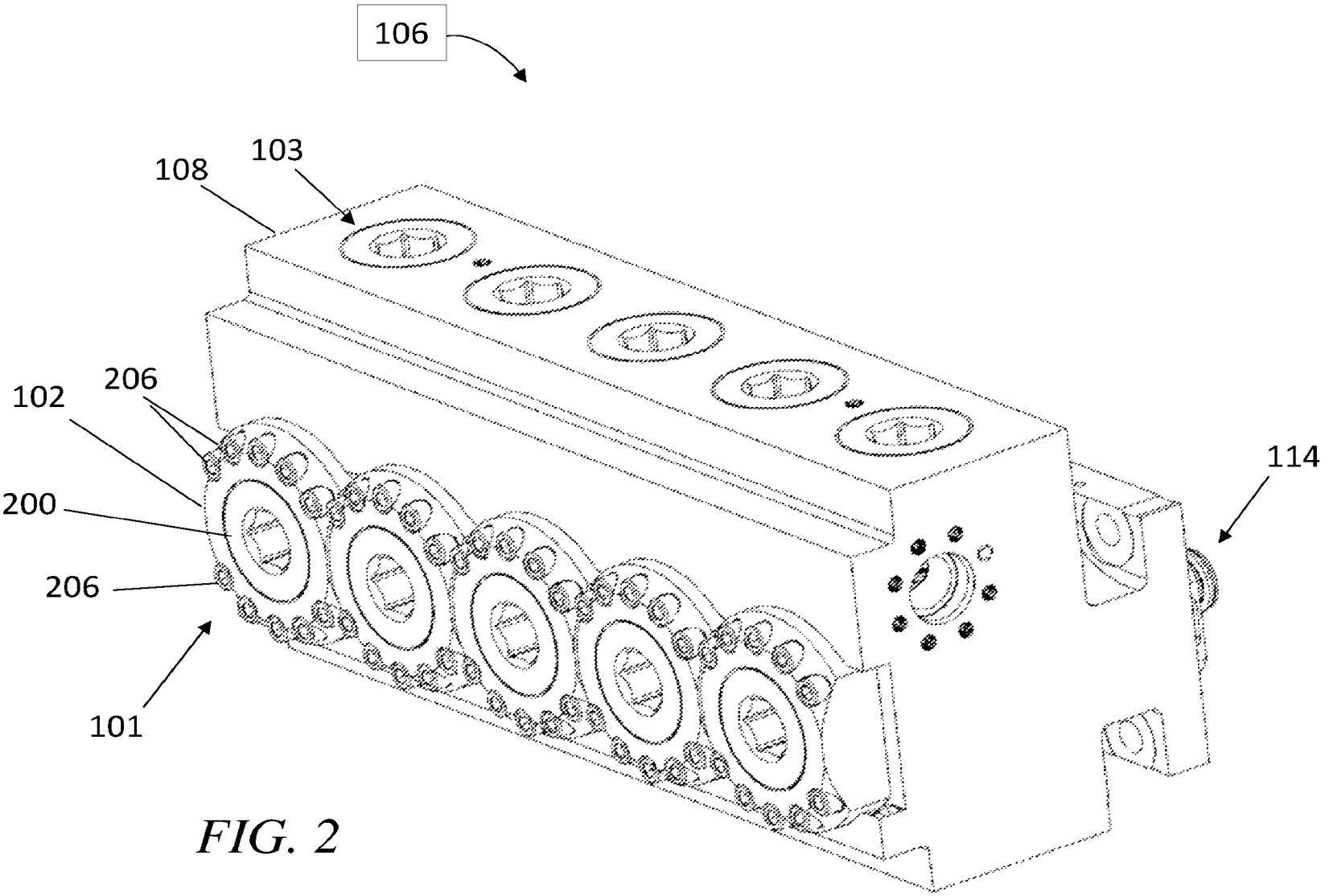
FIGS. 2-4 are perspective, side, and front views of an example embodiment of a fluid end of a positive displacement pump employing modular suction gland assemblies according to the teachings of the present disclosure.
Figure 3:
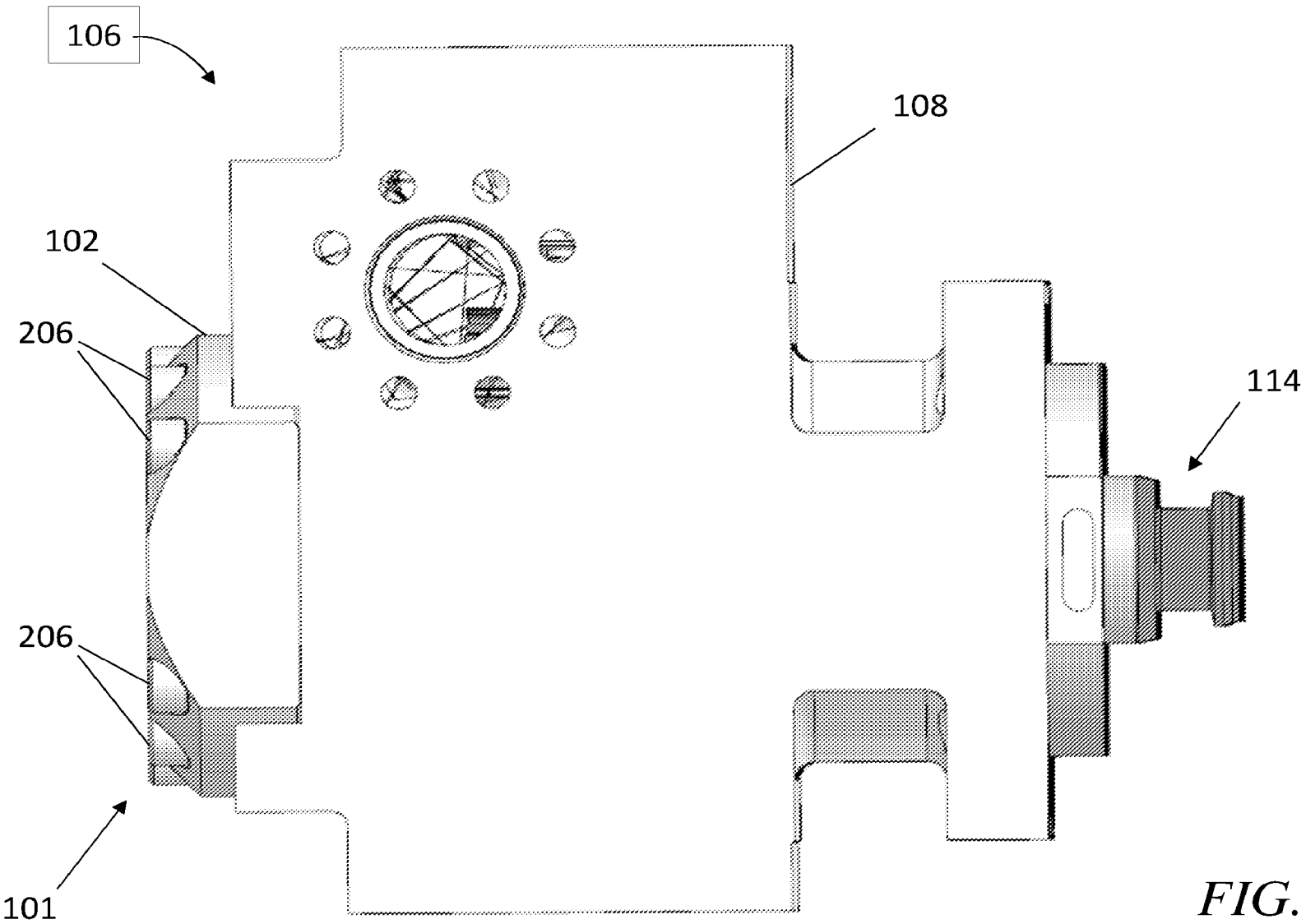
Figure 4:
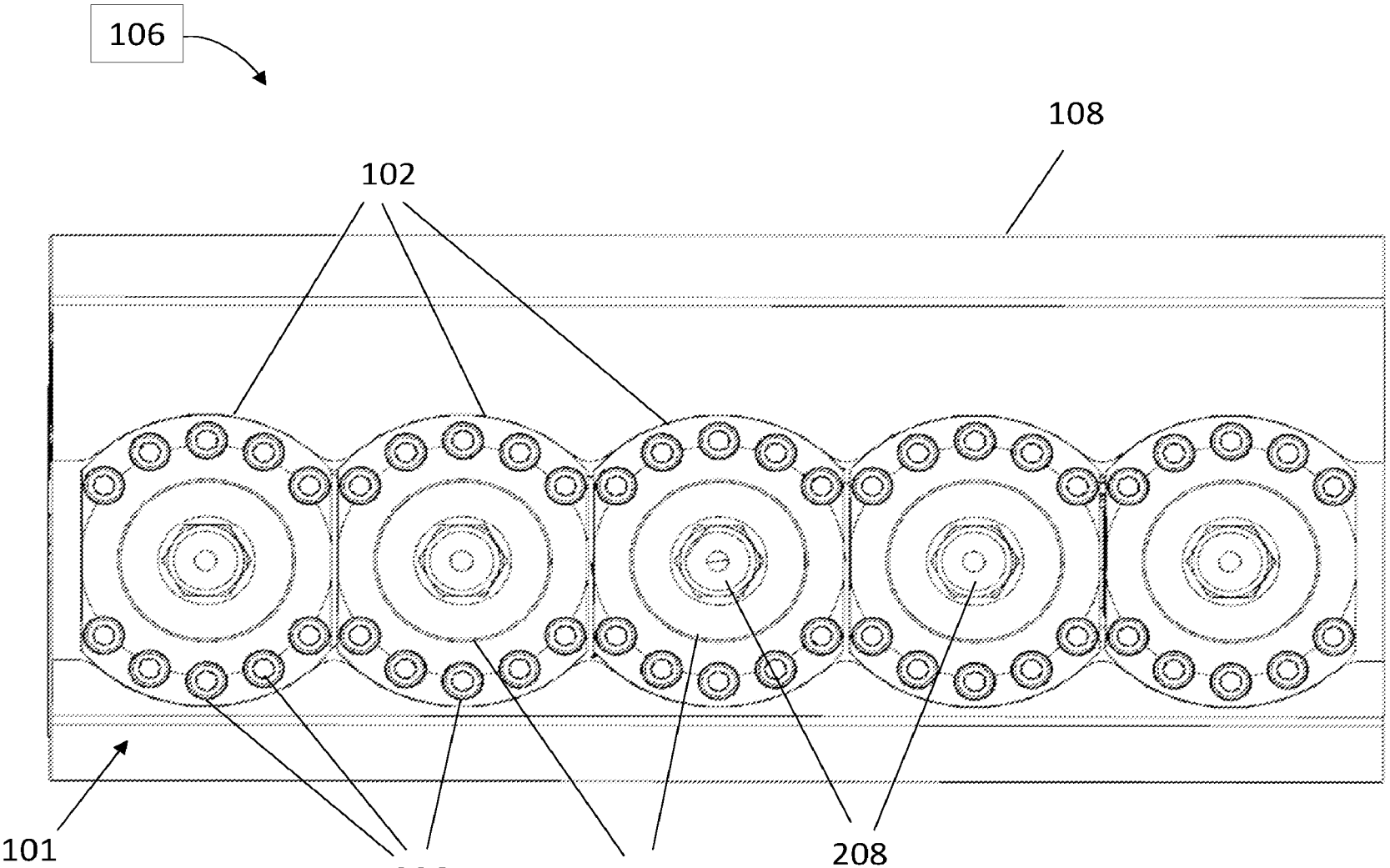
Figure 5:
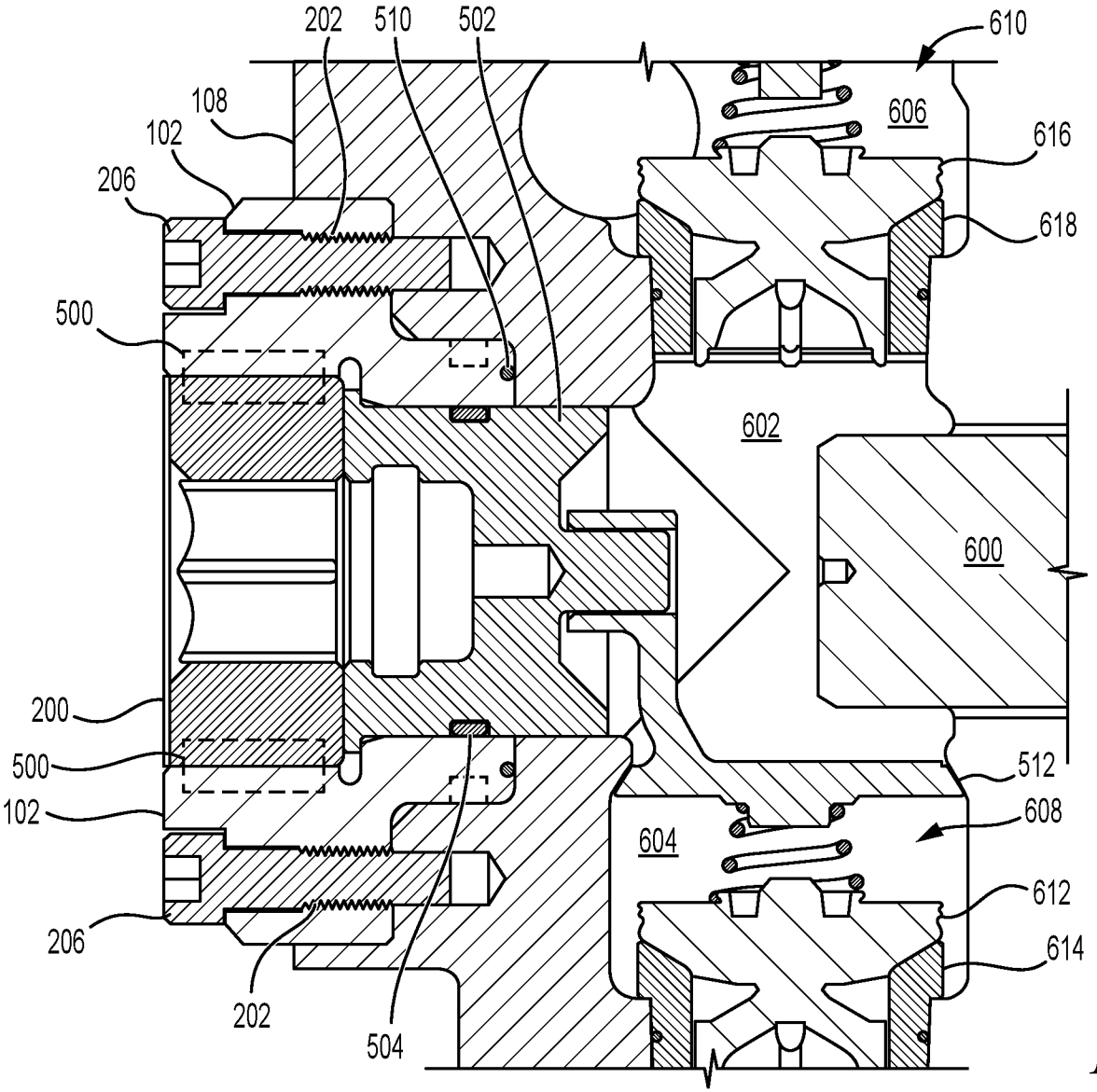
FIGS. 5 and 6 are partial cross-sectional views of example embodiments of a modular packing gland assembly for the fluid end of a positive displacement pump according to the teachings of the present disclosure.
Figure 6:
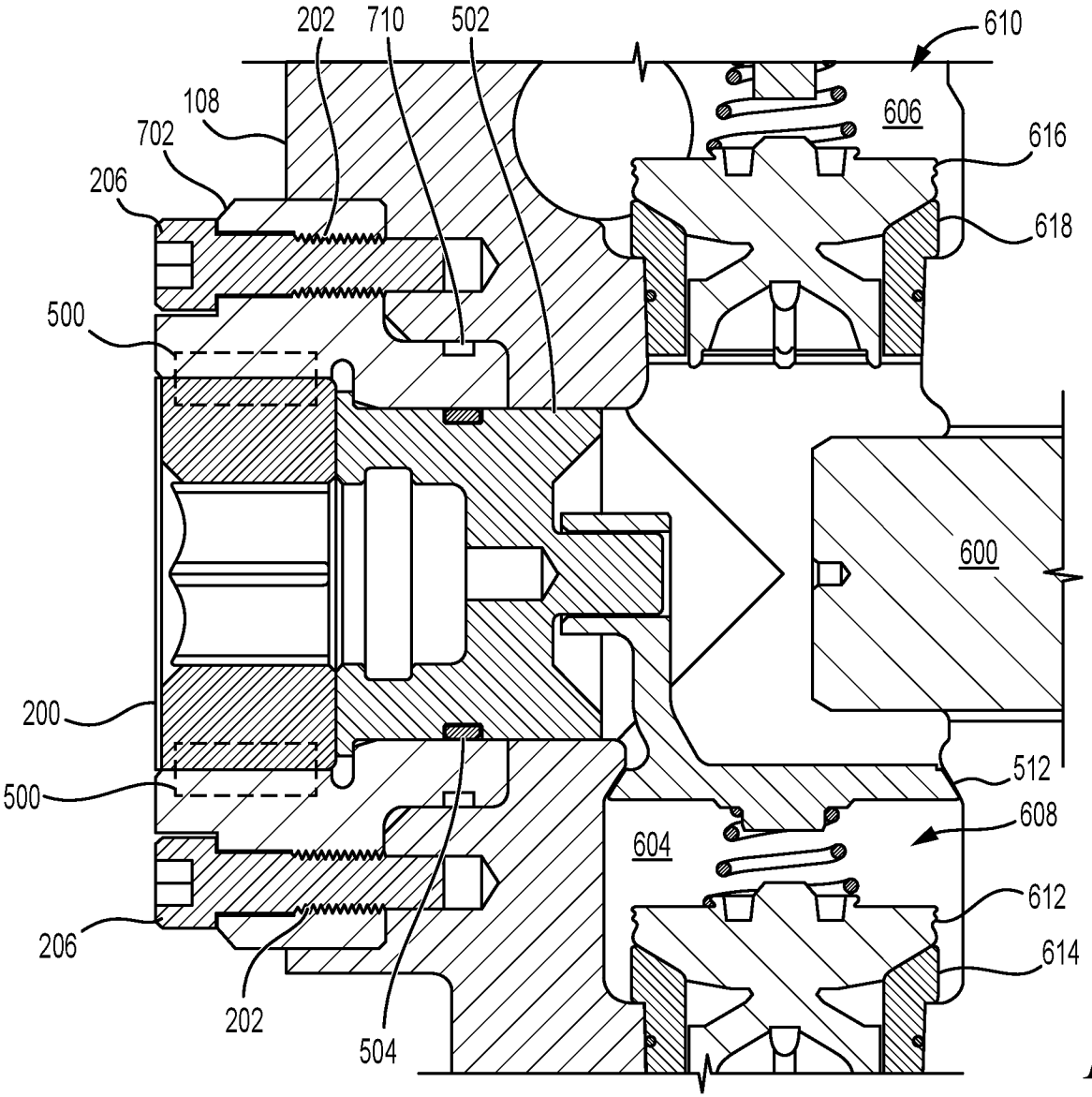

Referring to various exterior views of the fluid end 106 shown in FIGS. 2-4 and partial cross-sectional views of the fluid end shown in FIGS. 5 and 6, the novel modular suction cover assembly solution is provided by using a suction gland 102 as the threaded connection 500 to a retainer nut 200 that serves to retain the suction cover 502 in place to close off the suction access port. Best shown in FIG. 5, an embodiment of the modular suction gland 102 includes a threaded inner circumferential surface that interfaces and connects with a threaded outer circumferential surface of the retainer nut 200. The retainer nut 200 has an axial hexagonal-shaped cavity 208 that is designed to receive and interface with a hexagonal-shaped tool that can be used to rotate and tighten the retainer nut 200 within the threaded tubular cavity of the modular suction gland 102. The retainer nut 200, when securely engaged with the threaded interface of the modular suction gland 102, abuts against the suction cover 502 and keeps it in place within the suction access bore. The modular suction gland 102 itself is securely fastened to the fluid end block 108 by one or more threaded fasteners 206, such as bolts or socket head cap screws (SHCS), which are received in threaded openings 202 formed in the modular suction gland 102 and threaded cavities formed in the fluid end block 108 spaced and arranged in an offset manner about the suction access port opening. An annular suction cover seal 504 having a suitable cross-sectional shape (e.g., circular or D) is disposed in an annular groove defined in an outer circumference of the suction cover 502 at an interface between the suction cover 502 and the modular suction gland 102. As shown in FIG. 5, a face seal 510 is disposed in an annular groove formed on a face of the modular suction gland 102 to provide sealing engagement at a mating surface between the suction gland 102 and the fluid end block 108. In an alternate embodiment of the suction gland 702 shown in FIG. 7, a piston seal 710 is disposed in an annular groove formed on an outer circumferential surface of the modular suction gland 702 to provide sealing engagement at a mating surface between the suction gland and the fluid end block 108.

It may be seen that the modular suction gland and the retainer nut 200 project beyond the face of the fluid end block 108 and as a result, the length of threaded interface between the suction gland and retainer nut 200 may also at least partially extend beyond the face of the fluid end housing.

It may be seen in FIGS. 5 and 6 that the plunger rod assembly includes a plunger 600 extending through a bore into a pressure chamber 602 defined within the fluid cylinder. The fluid cylinder includes fluid inlet and outlet passages leading from the suction manifold 116 to the discharge manifold 118. An inlet valve assembly 608 is disposed in the fluid inlet passage 604 and an outlet valve assembly 610 is disposed in the fluid outlet passage 606. The inlet valve assembly 608 includes a valve body 612 engaged with a valve seat 614, and the outlet valve assembly 610 includes a valve body 616 engaged with a valve seat 618. A generally L-shaped valve keeper 512 is disposed at the mouth of the passageway leading to the inlet valve.

The innovation described herein eliminates the retainer nut threads from the fluid end block 108. Instead, the modular suction gland (102 or 702) that can be bolted to the fluid end block 108 using threaded fasteners 206, is used to secure the suction cover 502 and retainer nut 200 within the suction access bore. The retainer nut 200 includes a threaded outside circumference that engages the threaded inside circumference of the modular suction gland, forming a threaded connection. The retainer nut 200 abuts the suction cover seal 504 disposed over the suction access bore within the fluid cylinder. The sealing ring 504 is disposed in a groove at an interface between the suction cover 502 and the modular suction gland. Configured in this way, the suction cover sealing surface and the threaded interface with the retainer nut are moved from the fluid cylinder to the modular suction gland. If this threaded interface fails, the modular suction gland and the retainer nut 200 can be more easily replaced. Further, by using the modular bolt-on gland 102, its threaded engagement with the retainer nut 200 can be strengthened. More thread engagement is achieved by extending the modular suction gland and its threaded connection with the retainer nut 200 outward beyond the physical envelope of the fluid end block 108.

The features of the present invention which are believed to be novel are set forth below with particularity in the appended claims. However, modifications, variations, and changes to the exemplary embodiments described above will be apparent to those skilled in the art, and the modular suction gland assembly for the fluid end of a reciprocating pump described herein thus encompasses such modifications, variations, and changes and are not limited to the specific embodiments described herein.

What is claimed is:

1. A pump having a fluid end housing comprising:

a suction cover disposed in a suction access bore defined in a fluid end housing, the suction cover being configured to cover the suction access bore;

a retainer nut configured for abutting against the suction cover and retaining the suction cover within the suction access bore; and a suction gland having defined therein a tubular cavity configured for being coaxially disposed within the suction access bore, the tubular cavity having an inner circumferential threaded interface configured to engage an external circumferential threaded interface on the retainer nut, the suction gland further having a plurality of threaded openings configured to receive a plurality of threaded fasteners configured for securely fastening the suction gland to the fluid end housing.

2. The pump of claim 1, further comprising an annular seal disposed in an annular groove defined in an outer circumferential surface of the suction cover that is configured to interface and engage with an inner circumferential surface of the suction gland.

3. The pump of claim 1, wherein the suction gland and the retainer nut extend beyond the fluid end housing.

4. The pump of claim 1, wherein the threaded interfaces of the suction gland and the retainer nut extend beyond an outer surface of the fluid end housing when the retainer nut is rotatably engaged with the suction gland.

5. The pump of claim 1, wherein the plurality of threaded openings in the suction gland are distributed about the tubular cavity in an offset manner.

6. The pump of claim 1, further comprising an annular seal disposed in an annular groove defined in a surface of the modular suction gland that is configured to interface and engage with the fluid end housing.

7. The pump of claim 6, wherein the annular seal comprises at least one of a face seal and a piston seal.

8. A modular suction gland assembly for a suction access bore defined in a fluid end housing of a reciprocating pump, comprising:

a suction cover configured to cover the suction access bore;

a retainer nut configured for abutting against the suction cover and retaining the suction cover within the suction access bore; and a suction gland having defined therein a plurality of threaded openings configured to receive a plurality of threaded fasteners configured for securely fastening the suction gland about the suction access bore, the retainer nut being rotatably engageable with a threaded cavity of the suction gland to retain the suction cover within the suction access bore.

9. The modular suction gland assembly of claim 8, wherein the suction gland has an inner circumferential threaded interface configured to engage an external circumferential threaded interface defined on the retainer nut.

10. The modular suction gland assembly of claim 8, further an annular seal is disposed within an annular groove defined in an outer circumferential surface of the suction cover that engages an inner circumferential surface of the suction gland.

11. The modular suction gland assembly of claim 8, wherein the suction gland and the retainer nut extend beyond an outer surface of the fluid end housing.

12. The modular suction gland assembly of claim 9, wherein the threaded interfaces of the suction gland and the retainer nut extend beyond an outer surface of the fluid end housing when the retainer nut is rotatably engaged with the suction gland.

13. The modular suction gland assembly of claim 8, wherein the plurality of threaded openings in the suction gland for engaging the plurality of threaded fasteners are distributed about the threaded cavity in an offset manner.

14. The modular suction gland assembly of claim 8, further comprising an annular seal disposed in an annular groove defined in a surface of the modular suction gland that is configured to interface and engage with the fluid end housing.

15. The modular suction gland assembly of claim 8, wherein the annular seal comprises at least one of a face seal and a piston seal.

16. A positive displacement pump having a power end coupled to a fluid end, the fluid end of the pump comprising:

a plurality of pressure chambers defined within the fluid end;

a plurality of suction access bores defined within the fluid end and each being in fluid communication with a respective one of the plurality of pressure chambers;

a plurality of suction access ports defined in the fluid end each being in fluid communication with a respective one of the plurality of suction access bores;

a plurality of suction covers each being disposed in a respective one of the plurality of suction access ports, each suction cover being configured to cover a respective suction access port;

a plurality of retainer nuts configured for abutting against a respective one of the plurality of suction covers and retaining the suction cover within the respective suction access bore and covering the suction access port; and a plurality of modular suction glands each having defined therein a tubular cavity having an inner circumferential threaded interface configured to engage an external circumferential threaded interface defined on a respective one of the plurality of retainer nuts, each modular suction gland further having a plurality of threaded openings configured to receive a plurality of threaded fasteners configured for securely fastening the suction gland to the fluid end over a respective one of the plurality of suction access ports.

17. The pump of claim 16, further comprising a plurality of seals each being disposed in an annular groove defined in an outer circumferential surface of a respective one of the plurality of suction covers that interfaces with an inner circumferential surface of a respective one of the plurality of the modular suction glands.

18. The pump of claim 16, wherein each of the modular suction gland and the respective one of the retainer nut extend beyond an outer face of the fluid end.

19. The pump of claim 16, wherein the threaded interfaces of each modular suction gland and the respective one of the retainer nut extend beyond an outer surface of the fluid end when the retainer nut is rotatably engaged with the suction gland.

20. The pump of claim 16, wherein the plurality of threaded openings defined in each modular suction gland are distributed about the tubular cavity in an offset manner.

21. The pump of claim 16, further comprising a plurality of seals each being disposed in an annular groove defined in a surface of a respective one of the plurality of modular suction glands that is configured to interface and engage with the fluid end.

* * * * *